US008651484B1

(12) United States Patent
Gould et al.

(10) Patent No.: US 8,651,484 B1
(45) Date of Patent: Feb. 18, 2014

(54) SELECTION DEVICES AND METHODS OF MAKING SELECTION DEVICES

(75) Inventors: David Gould, Johns Creek, GA (US); Lynn Carroway, Buford, GA (US); Brett Jarriel, Aiken, SC (US); Michael Sinnette, Lawrenceville, GA (US)

(73) Assignee: ThermoPro Inc., Duluth, GA (US)

( * ) Notice: Subject to any disclaimer, the term of this patent is extended or adjusted under 35 U.S.C. 154(b) by 252 days.

(21) Appl. No.: 13/206,893

(22) Filed: Aug. 10, 2011

(51) Int. Cl.
*A63F 5/00* (2006.01)

(52) U.S. Cl.
USPC ..... 273/142 R; 273/142 D; 273/142 F; 273/142 G

(58) Field of Classification Search
USPC ..... 273/142 R, 142 E, 142 A–142 D, 142 F, 273/142 G
See application file for complete search history.

(56) References Cited

U.S. PATENT DOCUMENTS

| | | | | |
|---|---|---|---|---|
| 105,468 | A | | 7/1870 | Marais |
| 130,234 | A | | 8/1872 | Murray |
| 1,516,827 | A | | 8/1922 | Read |
| 1,780,256 | A | | 11/1930 | Walss |
| 2,012,673 | A | | 8/1935 | Urbach |
| 2,032,677 | A | | 3/1936 | Watson |
| D151,385 | S | * | 10/1948 | Nagel ..... D21/339 |
| 2,721,082 | A | * | 10/1955 | Hunold ..... 273/142 F |
| 3,905,547 | A | | 9/1975 | Cyre et al. |
| 4,395,043 | A | | 7/1983 | Gargione |
| 5,676,376 | A | | 10/1997 | Valley |
| 6,059,290 | A | | 5/2000 | Neil |
| 6,322,072 | B1 | | 11/2001 | Mair et al. |
| 7,841,597 | B2 | | 11/2010 | Cammegh |
| 2002/0127524 | A1 | * | 9/2002 | Kowalke et al. ..... 434/238 |
| 2005/0288089 | A1 | | 12/2005 | Cammegh et al. |

* cited by examiner

*Primary Examiner* — Benjamin Layno
(74) *Attorney, Agent, or Firm* — Kilpatrick Townsend & Stockton LLP

(57) ABSTRACT

Selection devices are provided that comprise a sheet mechanically attached above the surface of a base such that prize or other selection references can be positioned and displayed at different selectable locations on the device. The sheet may mechanically attach above the surface of the base by interacting with the base at a plurality of locations on the base. The sheet may mechanically interact with, for example, radially-oriented, ribs projecting in wheel spoke-like locations above the surface of the base. Paper or cards placed between such ribs and also between the base and clear sheet may display information about individual selectable items that are won or otherwise selected based on a spin of the wheel.

20 Claims, 4 Drawing Sheets

SELECTION DEVICES AND METHODS OF MAKING SELECTION DEVICES

FIELD

Embodiments generally relate to prize wheels and similar selection devices and more specifically relate to selection devices that display a plurality of prizes or other selectable alternatives.

BACKGROUND

Prize wheels are commonly used to allow random selection of a prize from multiple alternative prizes. An exemplary prize wheel displays prize references and is spun relative to a clicker or other indicator such that a prize is selected based on which prize is identified by the indicator when the wheel stops spinning. Because the spinning of the prize wheel is largely unpredictable, the selection of a prize based on the spinning of the prize wheel is likewise largely unpredictable. As another example, a prize wheel may display one or more prize references and one or more no prize references and be spun relative to an indicator such that whether a prize is won or not won is selected based on the indicator pointing to a prize reference or a no prize reference, respectively, when the wheel stops spinning.

For some prize wheels, the references displayed on a prize wheel are removable. For example, individual prize references have been printed on pie-shaped paper and are positioned at various positions on a prize wheel. In such prize wheels, prize references have been held in place between a prize wheel base and a separately-formed clear sheet of material attached to that base. Such prize wheels have been assembled using glue to attach the clear sheet to rib-like projections projecting in wheel spoke-like locations above the surface of the base. Paper or cards placed between the individual rib-like projections and also between the base and clear sheet displayed information about individual prizes or other selectable items that were won or otherwise selected based on a spin of the wheel. The references to the prizes and other selectable options were held in place but visible through the clear sheet.

SUMMARY

One embodiment comprises a device having a base comprising a center and base connection locations separate from the center, the base capable of spinning relative to the center. The device further has a sheet comprising sheet connection locations, the sheet attached to the base by mechanical interactions between the base at the base connection locations and the sheet at the sheet connection locations. Display elements are secured in respective positions relative to the base and the sheet.

Another exemplary embodiment provides a prize wheel that has a base having a surface with a circular circumference, a center in the middle of the surface, and radially-oriented ribs projecting above the surface and extending from positions nearer the center to positions further from the center at regularly-spaced intervals around the center of the base. The radially-oriented ribs of this exemplary prize wheel may comprise overhangs. The exemplary prize wheel further has a clear sheet having slots at locations approximately equidistant from a center of the clear sheet and at regularly-spaced intervals around that center. The radially oriented ribs of this exemplary prize wheel project through the slots such that the overhangs of the base overhang the sheet to attach the sheet to the base.

Another exemplary embodiment involves forming a base comprising a center and base connection locations separate from the center, the base capable of spinning relative to the center. The exemplary embodiment further involves forming a sheet comprising sheet connection locations. The exemplary embodiment further involves attaching the sheet to the base using mechanical interactions between the base at the base connection locations and the sheet at the sheet connection locations, the sheet attached to the base providing spaces between the sheet and base for attaching display elements.

BRIEF DESCRIPTION OF THE DRAWINGS

The specification makes reference to the following appended figures, in which use of like reference numerals in different figures is intended to illustrate like or analogous components.

DETAILED DESCRIPTION

Selection devices are provided that comprise a sheet mechanically attached above the surface of a base such that prize or other selection references can be positioned and displayed at different selectable locations on the device. The sheet may mechanically attach above the surface of the base by interacting with the base at a plurality of locations on the base. The sheet may mechanically interact with, for example, radially-oriented ribs projecting in wheel spoke-like locations above the surface of the base. Paper or cards placed between such ribs and also between the base and sheet may display information about individual selectable items that are won or otherwise selected based on a spin of the wheel. The mechanical attachment between the sheet and the base may, for example, be achieved using one or more base ribs configured to extend only partway towards the device center and a sheet shaped to interact with one or more of the ribs, for example, by having indentations with which individual ribs can interact. As a more specific example, individual ribs may have indentations to form overhangs such that the sheet can snap into place under or otherwise be secured under the overhangs of the ribs. A mechanical interaction or other attachment at the center of the wheel may also further attach the base to the sheet.

The use of one or more mechanical connections between the base and clear sheet can reduce or eliminate the need to connect such components using glue or other adhesive. Using such mechanical connections may make it easier to secure the clear sheet in a more precise location than was previously possible, for example, ensuring that the clear sheet is appropriately centered and allow even spinning of the wheel. Using such mechanical connections may reduce or eliminate the chance of glue or adhesive smearing during assembly and thus avoid the potential for associated cosmetic or functional flaws. Using such mechanical connections may reduce the care, user experience, and/or time necessary to attach a sheet to a base of a prize wheel or other selection device. Using such mechanical connections may reduce or eliminate the need to use an ultraviolet oven or other technique to cure adhesive in manufacturing a prize wheel or other selection device. Using such mechanical connections may reduce or eliminate the possibility of uneven adhesive use, the corresponding potential of uneven weight distribution, and the need to test for and correct uneven weight distribution to ensure that a wheel or device will spin as desired. Thus, generally, using such mechanical connections may reduce labor, simplify assembly, reduce the time required for manufacturing and testing selection devices, and otherwise reduce production costs. A lighter or otherwise better quality product that may be produced in less time, for less money, and/or using less material.

Figure 1:
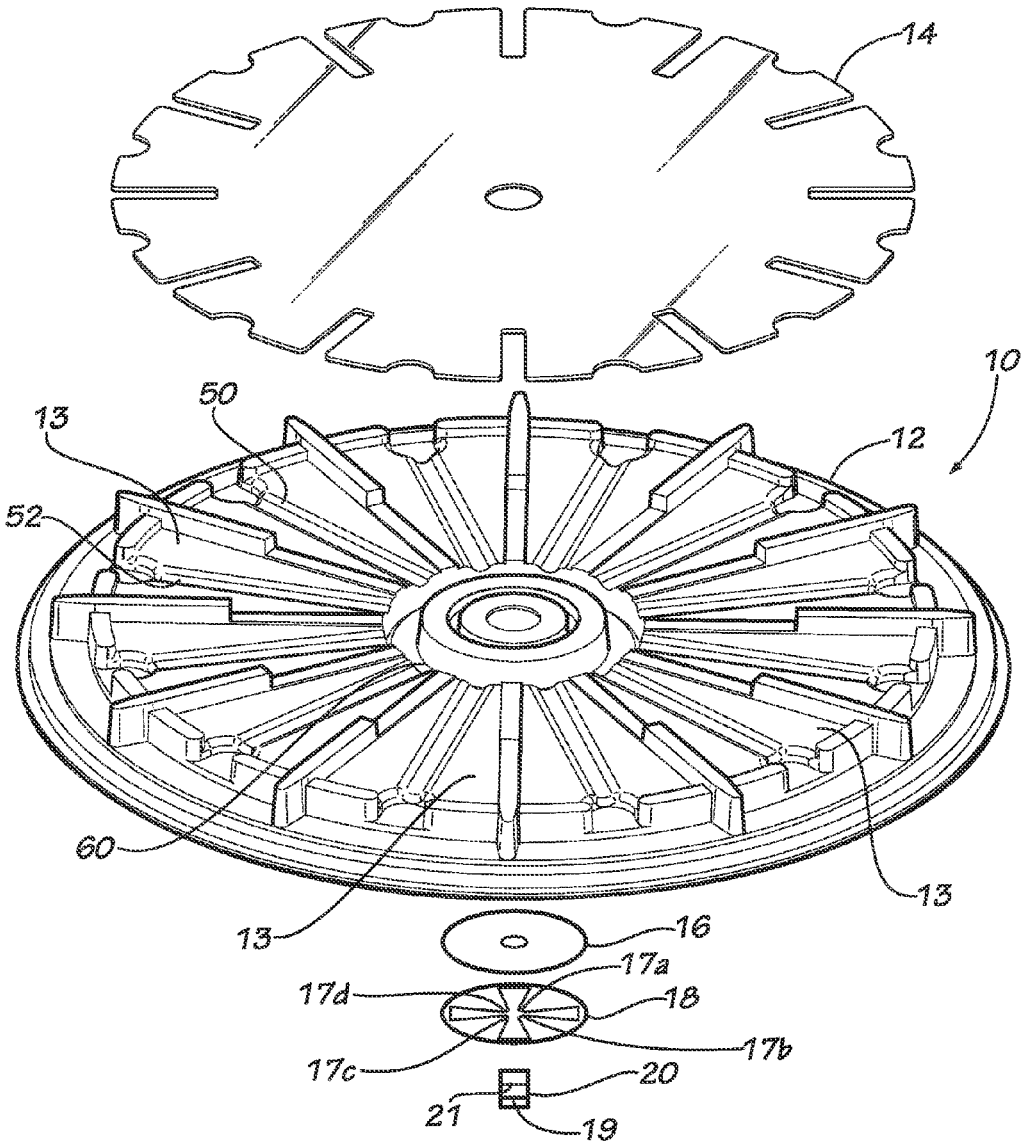
FIG. 1 is an exploded perspective view of an exemplary selection device.
Figure 2:
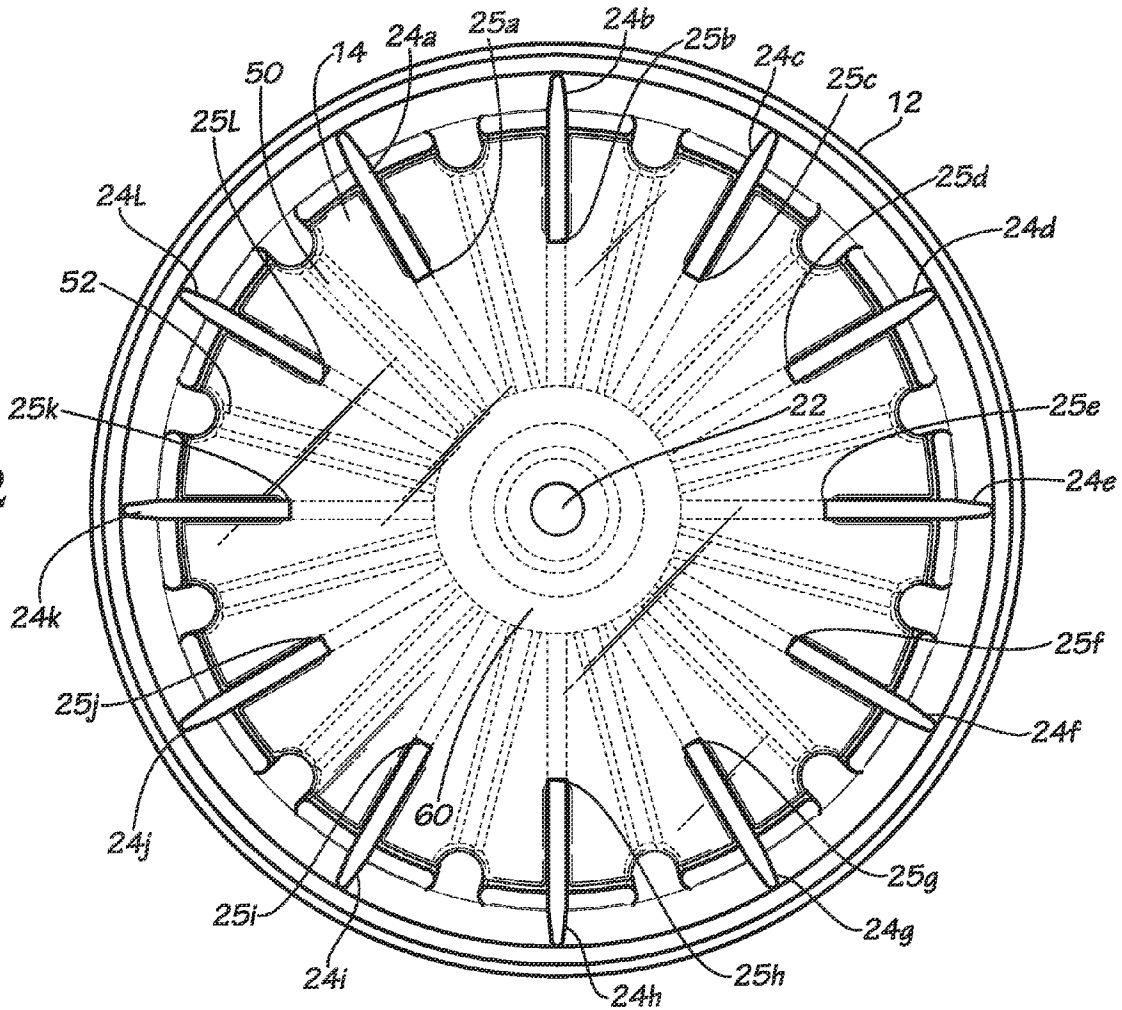
FIG. 2 is a top plan view of the selection device of FIG. 1.

Referring now to the Figures, FIG. 1 is an exploded perspective view of an exemplary selection device 10. The selection device 10 comprises a base 12, a sheet 14, a center plate 16, a locking plate 18, and a hub 20. FIG. 2 is a top plan view of the selection device 10 of FIG. 1. The base 12 has a center 22, and ribs 24A-L at base connection locations 25A-L separate from the center 22. In this example, the base connection locations 25A-L are approximately equidistant from the center 22 of the base 12 and at regularly-spaced intervals around the center 22 of the base 12. The ribs 24A-L are radially-oriented ribs projecting above a surface 13 of the base 12 and extending from positions nearer the center 22 to positions further from the center. Display elements (not shown) may be positioned and secured between the ribs 24A-L. For example, a card with a graphic identifying a first prize may be positioned between rib 24A and rib 24B and another card with a graphic identifying a second prize may be positioned between rib 24B and rib 24C, and so on between the ribs 24A-L around the selection device 10. Ribs 24A-L have a height sufficient to allow them to extend above surface 13 sufficiently to both hold the prize pieces in place and provide an area into which a slit can be routed or otherwise provided.

Figure 3:
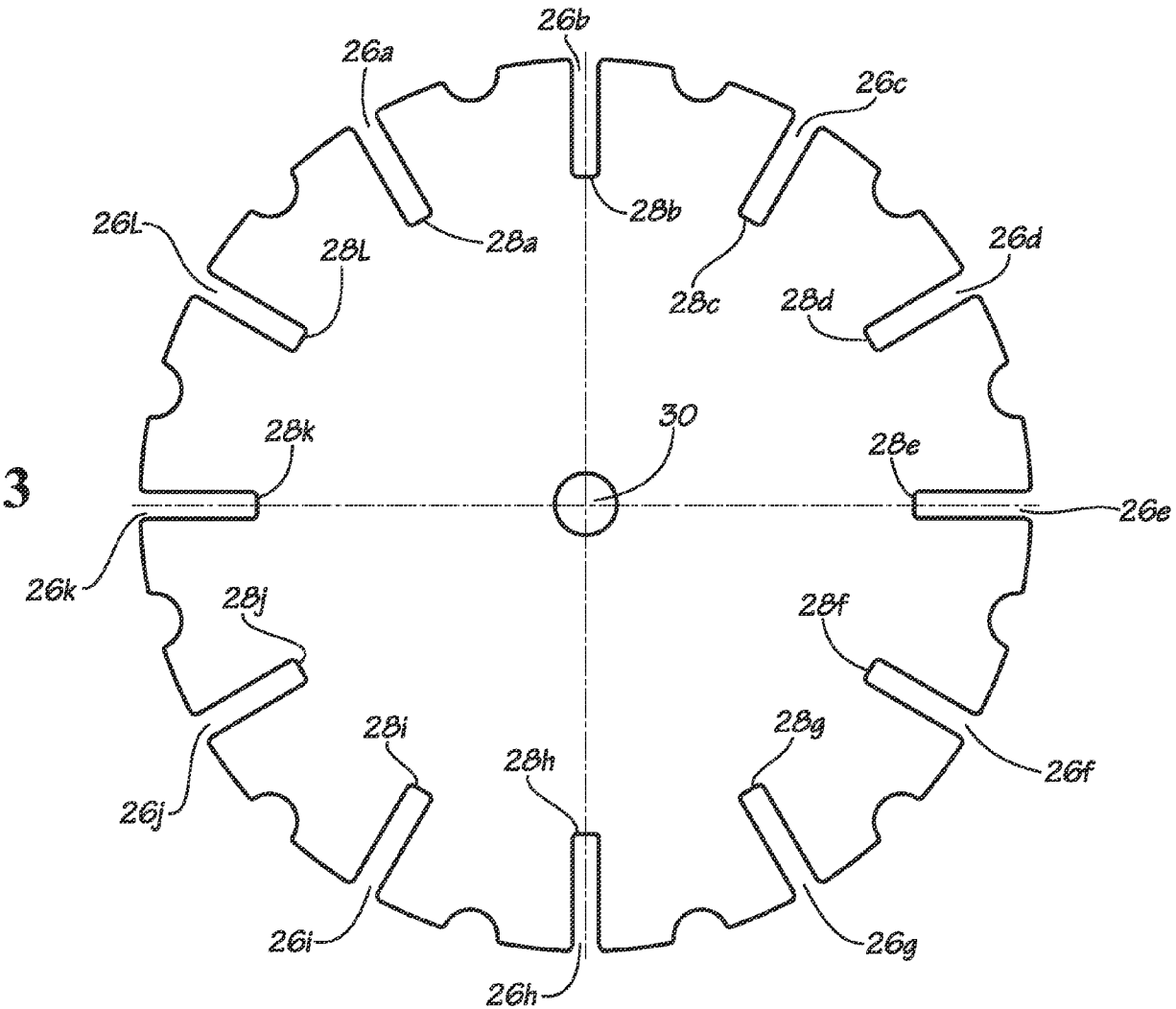
FIG. 3 is a top plan view of the sheet of the selection device of FIG. 1.

FIG. 3 illustrates a top plan view of the sheet 14 of the selection device 10 of FIG. 1. The sheet 14 has slots 26A-L providing sheet connection locations 28A-L. To connect to the base, the sheet 14 attaches to the base 12 by mechanical interactions between the base 12 at the base connection locations 25A-L and the sheet 14 at the sheet connection locations 28A-L. The slots 26A-L provide the sheet connection locations 28A-L at locations approximately equidistant from a center 30 of the sheet 14 and at regularly-spaced intervals around the center 30 of the sheet 14. Display elements (not shown) may be secured in respective positions relative to the base 12 and the sheet 14.

The ribs 24A-L of the base 12 are shaped to provide overhangs at the base connection locations 28A-L for overhanging the sheet 14 at the sheet connection locations 28A-L to secure the sheet 14. The ribs 24A-L may be indented or cut to provide overhangs at the base connection locations 25A-L for overhanging the sheet connection locations 28A-L to secure the sheet 14.

Figure 4:
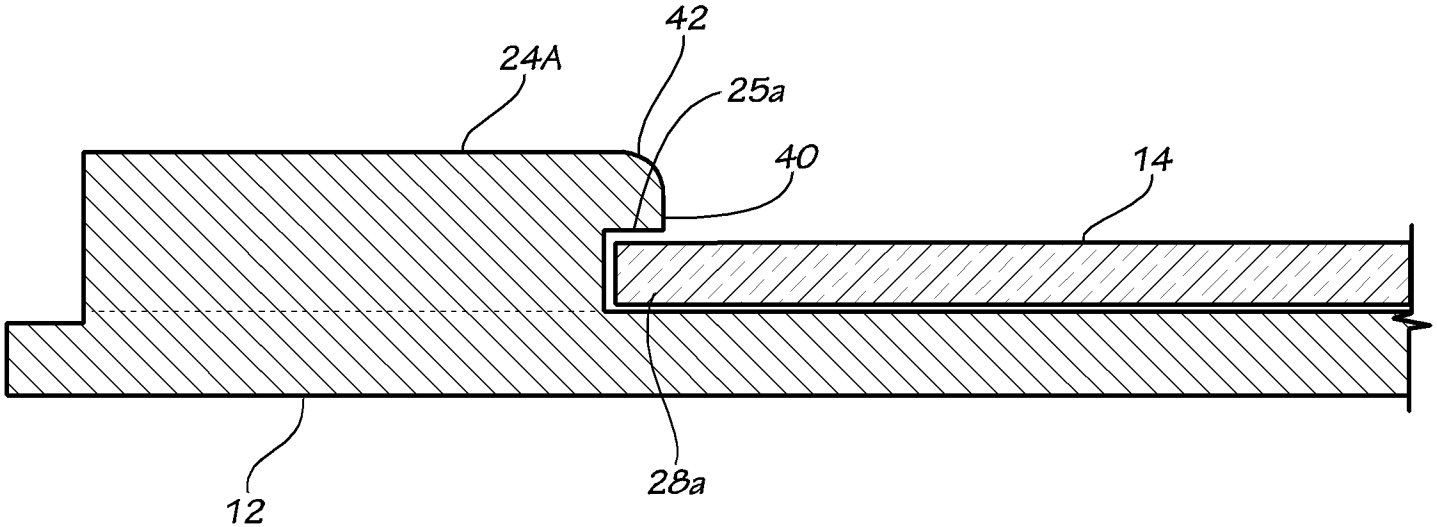
FIG. 4 is a side cross-sectional view of a portion of the selection device of FIG. 2 illustrating a rib providing an overhang for securing the sheet to the base.

FIG. 4 is a side cross-sectional view of a portion of the selection device 10 of FIG. 2 illustrating a rib 24A providing an overhang 40 for securing the sheet 14 to the base 12. Overhangs can be provided by some or all of the ribs 24A-L of FIG. 2. The size of the slit under the overhang 25A can be fractionally larger than the thickness of the sheet 14, e.g. ten thousandth of an inch larger, so that the sheet 14 is held in place snugly to avoid or reduce wobbling during spinning of the selection device 10. In one embodiment, overhangs are provided on every rib 24A-L of the selection device 10. In another embodiment, overhangs are provided on every other rib of the selection device 10. In FIG. 4, the overhang 40 of the rib 24A provides a curved shape 42 to facilitate a snap fitting of the sheet 14 onto the base 12. As the sheet 14 is pushed onto the base 12, the sheet may flex or bend to compress inwardly until snapping back into an unflexed or unbent position after being pushed below overhang 40.

Moreover, as shown in FIG. 2, the slots 26A-L of the sheet 14 are shaped to fit around the ribs 24A-L of the base 12. These interactions between base 12 and sheet 14 provide a mechanical (non-adhesive-based) attachment and connection between base 12 and sheet 14. Accordingly, while adhesive may be used to further secure the sheet 14 to the base 12, adhesive can be reduced in amount or avoided altogether if desired.

When assembled, the hub 20 (FIG. 1) provides a mechanism allowing the selection device 10 to spin when positioned on a peg or bolt (not shown) on a stand or wall (not shown). The hub 20 may further secure the center plate 16 and locking plate 18 to improve the structural integrity of the selection device 10. The locking plate 18 locks the hub 20 in place. The outside diameter of the hub 20 may be precision machined to interact with center holes in the sheet 14, base 12, center plate 16, and locking plate 18. The center holes may also be precision machined. The hub 20 has a flange 21. Assembling device 10 may involve inserting the hub 20 into the center holes of the sheet 14 and the base 12 so that the flange 21 is flush with and/or interacts with the sheet 14. Assembly may further involve then pressing center plate 16 onto the back of the hub 20 until positioned within a pocket (not shown) formed into the base 12. Such use of a center plate may improve the stability of device 10. The center plate may or may not also be glued to the back of the base 12. Assembly may further involve pressing the locking plate 18 onto the back of the hub 20 and the teeth 17A-D fit into a groove 19 in the hub 20 to secure the hub 20 with or without the use of glue or adhesive. If the hub 20 is not glued it may be removable to facilitate disassembly of the device 10, for example, to replace a damaged sheet 10 with a replacement sheet. The inclusion of a hub 20, a center plate 16, and/or a locking plate 18 may help reduce or eliminate the need for otherwise attaching a back piece, using a thicker base 12, or using a glued-on center plate, and/or reduce the associated labor. Alternative embodiments will omit and/or alter one or more of the base 12, sheet 14, center plate 16, locking plate 18, and hub 20 of the exemplary selection device 10.

Structural integrity of the selection device 10 may be enhanced by using a base 12 with a surface 13 that is not flat, for example, using a base 13 that has channels such as channels 50, 52 (FIG. 1 and FIG. 2). Note that to avoid cluttering the Figures only channels 50, 52 of the several channels illustrated are identified with numerals. Adding structural integrity to the base 12 may reduce or eliminate the need for a separate back piece and any gluing associated with the attachment of such a back piece. A base 12 that is not flat may not need to be as thick to achieve the same stability as a thicker flat base. Similarly, ribs 24A-L may be used to attach the sheet 14 to the base 12, and may also provide or enhance the structural stability of the base 12 and allow the base 12 to be thinner than a flatter base. The indent 60 (FIG. 1 and FIG. 2) around the center may be used to provide structural strength. The shape of the base may be configured to help reduce or eliminate the need for a back piece, a thicker base, and/or the associated labor.

In use, the exemplary selection device 10 may be placed on a stand or wall that provides a bolt or peg around which the selection device is able to spin. Specifically, the selection device 10 may be positioned so that the bolt or peg extends through a hole in the center of the hub 20 and supports the selection device 10. The hub 20, and thus the selection device 10, may be spun to revolve around the peg or bolt. A clicker or other selection indicator may interact with the selection device 10 as it spins around the peg. An exemplary clicker interacts with portions of the selection device 10, e.g., hitting edges of the ribs 24A-L as the selection device 10 spins to slow the spinning of the selection device 10 and make a clicking sound. When the selection device stops spinning, the clicker or other selection indicator may point to or otherwise identify a prize or other selected item displayed on the selection device.

Selection devices may have a variety of shapes and sizes. One exemplary selection device is a 20.5 inch diameter prize wheel. Another exemplary selection device is a 31 inch diameter prize wheel. Other sizes and shapes may also be used.

The base 12 may be formed of various materials including, but not limited to, acrylonitrile butadiene styrene (ABS), rubberized styrene plastic, high-impact styrene, other forms of styrene, wood, and other materials. Using a material that resists warping and/or that has relatively high impact strength may be beneficial for some, but not all, devices. The base 12 may be formed in various ways, for example, using a mold and thermoforming or vacuum forming a precise shape for the base 12. An exemplary mold is formed of machined aluminum created from a design drawn in a computer aided design (CAD) computer application.

The sheet 14 that attaches to the base 12 may be formed of various materials including, but not limited to, ABS, styrene, and other materials. Sheets used in some devices but not all embodiments are at least partially transparent. To be at least partially transparent, the sheet 14 may be formed of various materials including, but not limited to, polyethylene terephthalate glycol (PETG), acrylic, and other materials depending upon the particular embodiment. For example, if the embodiment involves a clear sheet that is required to bend or flex to snap into its attached position relative to the base, using PETG rather than acrylic may reduce the chances of cracking during assembly. The sheet 14 may be formed in various ways, for example, by cutting or routing an existing sheet or molding a new sheet of material.

The hub 20 may be formed of Delrin® available from E. I. du Pont de Nemours and Company of Wilmington, Del. or various other materials including, but not limited to, nylon and polycarbonate. The center plate 16 and locking plate 18 may be formed of various materials including, but not limited to, ABS, rubberized styrene plastic, high-impact styrene, other forms of styrene, and other materials.

Selection devices may be formed using a variety of assembly techniques. An exemplary selection device may be formed by, for example, manually positioning a clear sheet on a base and applying pressure to snap fit the clear sheet onto the base. A hub may additionally be attached to secure a center plate and locking plate.

Another exemplary method of making a selection device involves forming a base comprising a center and base connection locations separate from the center, the base capable of spinning relative to the center. Forming the base may comprise forming radially-oriented ribs projecting above a surface of the base and extending from positions nearer the center to positions further from the center and routing slits in the radially-oriented ribs to form overhangs at the base connection locations.

The exemplary method of making a selection device further involves forming a sheet comprising sheet connection locations. Forming the sheet may involve cutting, routing, or otherwise forming slots to provide the sheet connection locations.

The exemplary method of making a selection device further involves attaching the sheet to the base by non-adhesive interactions between the base at the base connection locations and the sheet at the sheet connection locations. The sheet is attached to the base to provide space between the sheet and base for positioning display references. Attaching the sheet may be manual, automated, or a combination thereof. Attaching the sheet may involve, for example, positioning the sheet above the base, applying pressure pushing the sheet onto the base such that the sheet flexes or bends in response to engaging the radially-oriented ribs, and continuing to apply pressure pushing the bent or flexed sheet further onto the base until the sheet is positioned below the overhangs and unbends or unflexes such that the overhangs secure the sheet to the base.

The exemplary method of making a selection device may further involve attaching the sheet to the base at the center of the base, for example, using the one or more of a hub, a center plate, and a locking plate.

An example of a selection device is a prize wheel. An exemplary prize wheel has a base having a surface with a circular circumference, a center in the middle of the surface, and radially-oriented ribs projecting above the surface and extending from positions nearer the center to positions further from the center at regularly-spaced intervals around the center of the base. The radially-oriented ribs of this exemplary prize wheel comprise overhangs at the locations nearer to the center. The exemplary prize wheel further has a clear sheet having slots at locations approximately equidistant from a center of the clear sheet and at regularly-spaced intervals around that center. The radially oriented ribs of this exemplary prize wheel project through the slots such that the overhangs of the base overhang the sheet to attach the sheet to the base.

The exemplary prize wheel further has one or more display elements secured in respective positions relative to the base and the sheet. The exemplary prize wheel holds the display references in place but allows end users of the prize wheel to replace the display references between uses, for example, to change the prizes offered from one event to the next event.

Display references may be formed of a variety of materials. In one embodiment, display references are formed of paper-based cards with text and/or images printed on them to identify prizes or other selected items. The text and graphics on such cards may be designed using standard or custom electronic content development applications, printed onto an appropriate material, and, if necessary, cut into a size and shape for insertion and use as part of a selection device. The prize wheel may allow such cards, for example, to slide between and be held in place between a base and a clear sheet. Stickers may additionally or alternatively be used as display references.

The disclosed embodiments are merely illustrative. In short, the techniques and the other features described herein have uses in a variety of contexts, not to be limited by the specific illustrations provided herein. The features shown are merely illustrative and are not intended to indicate that any component, feature, or method step is essential or necessary to any embodiment or limiting the scope of the present disclosure. The foregoing description of the embodiments has been presented only for the purpose of illustration and description and is not intended to be exhaustive or to limit the disclosure to the precise forms disclosed. Numerous modifications and adaptations are apparent to those skilled in the art without departing from the spirit and scope of the disclosure. For example, holes, slots, tabs, overhangs, pins and any or numerous other devices can be used to provide a mechanical connection between a selection device's base and its sheet. As a specific example, a hole drilled in a base may allow pins or screws to be inserted to secure the display references and/or to hold a sheet to the base.

What is claimed is:

1. A device comprising:

a base comprising a center and base connection locations separate from the center, the base capable of spinning relative to the center;

a sheet comprising sheet connection locations, the sheet attached to the base by non-adhesive mechanical interactions between the base at the base connection locations and the sheet at the sheet connection locations; and display elements secured in respective positions relative to the base and the sheet.

2. The device of claim 1 wherein the base connection locations are approximately equidistant from the center of the base and at regularly-spaced intervals around the center of the base.

3. The device of claim 1 wherein the base further comprises radially-oriented ribs projecting above a surface of the base and between the display elements to secure the display elements in the respective positions.

4. The device of claim 3 wherein the base connection locations are on the radially-oriented ribs of the base.

5. The device of claim 1 wherein the sheet attaches to the base at the center of the base.

6. A device comprising:

a base comprising a center and base connection locations separate from the center, the base capable of spinning relative to the center;

a sheet comprising sheet connection locations, the sheet attached to the base by mechanical interactions between the base at the base connection locations and the sheet at the sheet connection locations; and display elements secured in respective positions relative to the base and the sheet;

wherein the base further comprises radially-oriented ribs projecting above a surface of the base and between the display elements to secure the display elements in the respective positions, wherein the base connection locations are on the radially-oriented ribs of the base, wherein the radially-oriented ribs provide overhangs at the base connection locations for overhanging the sheet at the sheet connection locations to secure the sheet.

7. A device comprising:

a base comprising a center and base connection locations separate from the center, the base capable of spinning relative to the center;

a sheet comprising sheet connection locations, the sheet attached to the base by mechanical interactions between the base at the base connection locations and the sheet at the sheet connection locations; and display elements secured in respective positions relative to the base and the sheet;

wherein the base further comprises radially-oriented ribs projecting above a surface of the base and extending from positions nearer the center to positions further from the center, wherein the radially-oriented ribs are indented or cut at the locations nearer to the center to provide overhangs at the base connection locations for overhanging the sheet connection locations to secure the sheet.

8. A device comprising:

a base comprising a center and base connection locations separate from the center, the base capable of spinning relative to the center;

a sheet comprising sheet connection locations, the sheet attached to the base by mechanical interactions between the base at the base connection locations and the sheet at the sheet connection locations; and display elements secured in respective positions relative to the base and the sheet;

wherein the sheet comprises slots providing the sheet connection locations at locations approximately equidistant from a center of the sheet and at regularly-spaced intervals around the center of the sheet.

9. The device of claim 8 wherein the base further comprises radially-oriented ribs projecting above a surface of the base and between the display elements to secure the display elements in the respective positions, wherein the slots of the sheet fit around the radially-oriented ribs projecting above the surface of the base and the overhangs of radially-oriented ribs overhang the sheet at the sheet connection locations.

10. A device comprising:

a base comprising a center and base connection locations separate from the center, the base capable of spinning relative to the center;

a sheet comprising sheet connection locations, the sheet attached to the base by mechanical interactions between the base at the base connection locations and the sheet at the sheet connection locations; and display elements secured in respective positions relative to the base and the sheet;

wherein the device is a prize wheel, wherein the display elements are removable cards.

11. A device comprising:

a base comprising a center and base connection locations separate from the center, the base capable of spinning relative to the center;

a sheet comprising sheet connection locations, the sheet attached to the base by mechanical interactions between the base at the base connection locations and the sheet at the sheet connection locations; and display elements secured in respective positions relative to the base and the sheet;

wherein the sheet consists of only a first type of material and base consists of only a second type of material different from the first type of material.

12. A device comprising:

a base comprising a center and base connection locations separate from the center, the base capable of spinning relative to the center;

a sheet comprising sheet connection locations, the sheet attached to the base by mechanical interactions between the base at the base connection locations and the sheet at the sheet connection locations; and display elements secured in respective positions relative to the base and the sheet;

wherein the sheet is at least partially transparent and the base is not transparent.

13. A method comprising:

forming a base comprising a center and base connection locations separate from the center, the base capable of spinning relative to the center;

forming a sheet comprising sheet connection locations; and attaching the sheet to the base by non-adhesive mechanical interactions between the base at the base connection locations and the sheet at the sheet connection locations, the sheet attached to the base providing spaces between the sheet and base for attaching display elements.

14. The method of claim 13 wherein attaching the sheet further comprises attaching the sheet to the base at the center of the base.

15. The method of claim 13 further comprising attaching a hub, center plate, and locking plate to the base.

16. A method comprising:

forming a base comprising a center and base connection locations separate from the center, the base capable of spinning relative to the center;

forming a sheet comprising sheet connection locations; and attaching the sheet to the base by mechanical interactions between the base at the base connection locations and the sheet at the sheet connection locations, the sheet attached to the base providing spaces between the sheet and base for attaching display elements;

wherein forming the base comprises:

forming radially-oriented ribs projecting above a surface of the base and extending from positions nearer the center to positions further from the center; and routing slits in the radially-oriented ribs to form overhangs at the base connection locations.

17. The method of claim 16 wherein forming the sheet comprises forming slots to provide the sheet connection locations.

18. The method of claim 17 wherein attaching the sheet comprises:

positioning the sheet above the base;

applying pressure pushing the sheet onto the base such that the sheet flexes or bends in response to engaging the radially-oriented ribs; and continuing to apply pressure pushing the bent or flexed sheet further onto the base until the sheet is positioned below the overhangs and unbends or unflexes such that the overhangs secure the sheet to the base.

19. The method of claim 18 wherein noses of the ribs are shaped to cause the sheet to flex or bend when pushed onto the base.

20. A prize wheel device comprising:

a base comprising a surface having a circular circumference, a center in the middle of the surface, and radially-oriented ribs projecting above the surface and extending from positions nearer the center to positions further from the center at regularly-spaced intervals around the center of the base, wherein the radially-oriented ribs comprise overhangs at the locations nearer to the center;

a clear sheet comprising slots at locations approximately equidistant from a center of the sheet and at regularly-spaced intervals around the center of the sheet, wherein the radially oriented ribs of the base project through the slots such that the overhangs of the base overhang the sheet to attach the sheet to the base; and display elements secured in respective positions relative to the base and the sheet.

* * * * *